US009531142B2

(12) United States Patent
Xu et al.

(10) Patent No.: US 9,531,142 B2
(45) Date of Patent: Dec. 27, 2016

(54) ELECTRICAL CONNECTOR AND STACKED ELECTRICAL CONNECTOR FORMED BY THE SAME

(71) Applicant: LOTES CO., LTD., Keelung (TW)

(72) Inventors: Bin Qi Xu, Keelung (TW); Quan Long, Keelung (TW)

(73) Assignee: LOTES CO., LTD, Keelung (TW)

( * ) Notice: Subject to any disclaimer, the term of this patent is extended or adjusted under 35 U.S.C. 154(b) by 79 days.

(21) Appl. No.: 14/524,670

(22) Filed: Oct. 27, 2014

(65) Prior Publication Data

US 2015/0280375 A1 Oct. 1, 2015

(30) Foreign Application Priority Data

Mar. 27, 2014 (CN) ..... 2014 2 0141237 U

(51) Int. Cl.

| | |
|---|---|
| ***H01R 24/62*** | (2011.01) |
| ***H01R 13/6594*** | (2011.01) |
| *H01R 13/502* | (2006.01) |
| *H01R 12/70* | (2011.01) |
| *H01R 13/52* | (2006.01) |
| *H01R 43/24* | (2006.01) |
| *H01R 12/71* | (2011.01) |

(Continued)

(52) U.S. Cl.

CPC ..... *H01R 24/62* (2013.01); *H01R 13/6594* (2013.01); *H01R 12/707* (2013.01); *H01R 12/716* (2013.01); *H01R 12/724* (2013.01); *H01R 13/405* (2013.01); *H01R 13/502* (2013.01); *H01R 13/504* (2013.01); *H01R 13/521* (2013.01); *H01R 13/6582* (2013.01); *H01R 24/50* (2013.01); *H01R 43/24* (2013.01)

(58) Field of Classification Search

CPC ... H01R 12/716; H01R 12/724; H01R 12/707; H01R 13/502; H01R 24/50; H01R 24/504; H01R 43/24; H01R 13/405; H01R 13/521; H01R 13/504

USPC ..... 439/607.01, 607.11, 79, 676, 541.5

See application file for complete search history.

(56) References Cited

U.S. PATENT DOCUMENTS 6,033,258 A * 3/2000 Huang ..... H01R 12/724 439/541.5

6,210,235 B1 * 4/2001 Wu ..... H01R 24/64 439/607.36

(Continued)

*Primary Examiner* — Abdullah Riyami

*Assistant Examiner* — Justin Kratt

(74) *Attorney, Agent, or Firm* — Locke Lord LLP; Tim Tingkang Xia, Esq.

(57) ABSTRACT

An electrical connector includes a first body, multiple first conducting terminals and multiple second conducting terminals received in the first body, a first fixing block, and a second fixing block. Each first conducting terminal has a first extending portion, and a first welding portion extending downward from the first extending portion. Each second conducting terminal has a second extending portion, and a second welding portion extending downward from the second extending portion. The first extending portions and the second extending portions are disposed in a front and back manner. The first extending portions are insert injection molded at the first fixing block. The second extending portions are insert injection molded at the second fixing block. The first fixing block and the second fixing block cooperatively position the first welding portions and the second welding portions. A stacked electrical connector formed by two or more of the electrical connectors.

19 Claims, 7 Drawing Sheets

(51) Int. Cl.

| | |
|---|---|
| *H01R 24/50* | (2011.01) |
| *H01R 13/504* | (2006.01) |
| *H01R 12/72* | (2011.01) |
| *H01R 13/405* | (2006.01) |
| *H01R 13/6582* | (2011.01) |

(56) References Cited

U.S. PATENT DOCUMENTS

| | | | | |
|---|---|---|---|---|
| 7,591,688 | B2 * | 9/2009 | Wang | H01R 24/64 439/676 |
| 7,927,152 | B2 * | 4/2011 | Pepe | H01R 24/64 439/676 |
| 2010/0159746 | A1 * | 6/2010 | Wan | H01R 12/712 439/607.11 |
| 2012/0015554 | A1 * | 1/2012 | Tseng | H01R 13/6658 439/607.01 |
| 2012/0214351 | A1 * | 8/2012 | Shiratori | H01R 13/6471 439/692 |

* cited by examiner

100

100

ELECTRICAL CONNECTOR AND STACKED ELECTRICAL CONNECTOR FORMED BY THE SAME

CROSS-REFERENCE TO RELATED APPLICATION

This non-provisional application claims priority under 35 U.S.C. §119(a) on Patent Application No. 201420141237.7 filed in P.R. China on Mar. 27, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector that can position a welding portion of a conducting terminal without assembling a positioning socket, and a stacked electrical connector formed by the same.

BACKGROUND OF THE INVENTION

A Universal Serial Bus (USB) electrical connector 10, for example, as disclosed in Chinese Patent No. CN200920267166.4, includes a plastic insulator 12, multiple first terminals 20, multiple second terminals 30, and a fixing plate 40. A side of the plastic insulator 12 is provided with multiple through-holes 122. The first terminals 20 are insert-molded in the plastic insulator 12. The second terminals 30 are respectively assembled in the through-holes 122 of the plastic insulator 12. The fixing plate 40 is assembled at a rear end of the plastic insulator 12, and fixed to welding portions of the first terminals 20 and the second terminals 30. During assembly, at first, the second terminals 30 are inserted into the through-holes 122 of the plastic insulator 12 embedded with the first terminals 20, and then the fixing plate 40 and the plastic insulator 12 are fixed together. Multiple positioning holes are provided on the fixing plate 40 corresponding to the welding portions of the first terminals 20 and the second terminals 30. When the fixing plate 40 is retained on the plastic insulator 12, the welding portions of the first terminals 20 and the second terminals 30 correspondingly pass through the positioning holes.

However, before the fixing plate 40 of the USB electrical connector is assembled to the rear end of the plastic insulator 12, longitudinal dislocation easily occurs in the welding portions of the first conducting terminals 20 and the second conducting terminals 30, so that when the fixing plate 40 is assembled to the plastic insulator 12, it is very difficult for the welding portions of the first conducting terminals 20 and the second conducting terminals 30 to correspondingly pass through the positioning holes of the fixing plate 40. The assembly is inconvenient, and it is easy to deflect the welding portions of the terminals, thereby generating defective products.

Therefore, a heretofore unaddressed need exists in the art to address the aforementioned deficiencies and inadequacies.

SUMMARY OF THE INVENTION

In one aspect, the present invention is directed to an electrical connector that can position a welding portion of a conducting terminal without assembling a positioning socket, and a stacked electrical connector formed by the same.

In one embodiment, an electrical connector includes a first body, multiple first conducting terminals and multiple second conducting terminals received in the first body, a first fixing block, and a second fixing block. Each of the first conducting terminals has a first extending portion, and a first welding portion extending downward from the first extending portion. Each of the second conducting terminals has a second extending portion, and a second welding portion extending downward from the second extending portion. The first extending portions and the second extending portions are disposed in a front and back manner. The first extending portions are insert injection molded at the first fixing block, and the second extending portions are insert injection molded at the second fixing block. The first fixing block and the second fixing block cooperatively position the first welding portions and the second welding portions.

In one embodiment, the first fixing block and the second fixing block have a concave portion and a convex portion in cooperation with each other.

In one embodiment, each of the first conducting terminals includes a first retaining portion insert injection molded in the first body.

In one embodiment, the electrical connector further includes a second body, where each of the second conducting terminals has a second retaining portion insert injection molded in the second body.

In one embodiment, the first body includes a tongue. The tongue has multiple receiving slots and a groove. The second conducting terminals are correspondingly received in the receiving slots, and the second body is accommodated in the groove.

In one embodiment, the first conducting terminals include two first differential signal terminal pairs, and a first grounding terminal located between the two first differential signal terminal pairs. The two first welding portions of each of the first differential signal terminal pairs are deviated from each other.

In one embodiment, the second conducting terminals include a power supply terminal, a second grounding terminal, and a second differential signal terminal pair located between the power supply terminal and the second grounding terminal. The two second welding portions of the second differential signal terminal pair are deviated from each other.

In another aspect, the present invention is directed to an electrical connector that can position a welding portion of a conducting terminal without assembling a positioning socket.

In one embodiment, an electrical connector includes a first body having multiple receiving slots, a first fixing block disposed below the first body, multiple first conducting terminals, a second body assembled in the first body, a second fixing block disposed below the second body, and multiple second conducting terminals. Each of the first conducting terminals has a first retaining portion insert injection molded in the first body, a first extending portion bending downward and extending from a rear end of the first retaining portion, and insert injection molded in the first fixing block, a first contact portion extending forward from the first retaining portion and exposed from the first body, and a first welding portion extending downward from the first extending portion and exposed from the first fixing block. Each of the second conducting terminals has a second retaining portion insert injection molded in the second body, a second extending portion bending downward and extending from a rear end of the second retaining portion, and insert injection molded in the second fixing block, a second contact portion extending forward from the second retaining portion and exposed from the second body, and a second welding portion extending downward from the second extending portion and exposed from the second fixing block. The second contact portion is received in the receiving slot, located below the first contact portion, and exposed from the first body.

In one embodiment, the first fixing block and the second fixing block are disposed in a front and back manner. The first fixing block and the second fixing block cooperatively position the first welding portions and the second welding portions.

In one embodiment, the first fixing block and the second fixing block are each provided with an opening, and the opening runs through each of the first fixing block and the second fixing block from front to back.

In one embodiment, the first conducting terminals include two first differential signal terminal pairs, and a first grounding terminal located between the two first differential signal terminal pairs. The two first welding portions of each of the first differential signal terminal pairs are deviated from each other.

In one embodiment, the second conducting terminals include a power supply terminal, a second grounding terminal, and a second differential signal terminal pair located between the power supply terminal and the second grounding terminal. The two second welding portions of the second differential signal terminal pair are deviated from each other.

In a further aspect, the present invention is directed to a stacked electrical connector.

In one embodiment, a stacked electrical connector includes a first electrical connector, and at least one second electrical connector stacked above the first electrical connector. The second electrical connector has at least two rows of conducting terminals and at least two fixing blocks. Each of the conducting terminals has an extending portion, and a welding portion extending downward from the extending portion. The extending portions of the two rows of conducting terminals are disposed in two rows in a front and back matter. The two rows of extending portions are respectively insert injection molded in the two fixing blocks. The two fixing blocks cooperatively position welding portions of the two rows of conducting terminals.

In one embodiment, the second electrical connector includes a first body, the two rows of conducting terminals include multiple first conducting terminals and multiple second conducting terminals, and each of the first conducting terminals has a first retaining portion insert injection molded in the first body.

In one embodiment, the two fixing blocks include a first fixing block and a second fixing block, and each of the first conducting terminals has a first extending portion insert injection molded in the first fixing block.

In one embodiment, the second electrical connector further includes a second body, and each of the second conducting terminals has a second retaining portion insert injection molded in the second body and a second extending portion insert injection molded in the second fixing block.

In one embodiment, the first body includes a first tongue, and the second conducting terminals and the second body are assembled in the first tongue.

In one embodiment, the first electrical connector includes a third body, a fourth body, multiple third conducting terminals and multiple fourth conducting terminals. Each of the third conducting terminals has a third retaining portion insert injection molded in the third body, and each of the fourth conducting terminals has a fourth retaining portion insert injection molded in the fourth body.

In one embodiment, the first electrical connector further includes a third fixing block, and each of the third conducting terminals has a third extending portion insert injection molded in the third fixing block.

In one embodiment, the third body includes a second tongue, and the fourth conducting terminal and the fourth body are assembled in the second tongue.

In one embodiment, the stacked electrical connector further includes a main body. The main body includes a base portion. The base portion is provided with a first retaining slot and a second retaining slot which run through the base portion in a front and back manner. The first tongue and the second tongue are retained in the first retaining slot and the second retaining slot respectively.

In one embodiment, a rear end of the base portion is provided with an accommodating space, and the first fixing block, the second fixing block and the third fixing block are respectively accommodated in the accommodating space.

In one embodiment, multiple positioning slots are disposed below the rear end of the base portion, and each of the fourth conducting terminals has a fourth extending portion located in each of the positioning slots.

In one embodiment, a shielding sheet is disposed between the third fixing block and the second fixing block. The shielding sheet has a shielding portion, and wall portions located at two sides of the shielding portion.

In one embodiment, the two wall portions respectively wrap two sides of the first fixing block and the second fixing block, and the two wall portions are each provided with a buckling portion buckled on the second fixing block.

In one embodiment, rear ends of the two wall portions respectively extend in opposite directions and are each provided with an elastic arm. The first fixing block is provided with a notch corresponding to the elastic arm, and the elastic arm is received in the notch.

Compared with the related art, the electrical connector and the stacked electrical connector formed by the same of the present invention, among other things, have the following beneficial advantages.

Each of the first conducting terminals has a first extending portion insert injection molded in the first fixing block, and each of the second conducting terminals has a second extending portion insert injection molded in the second fixing block, so that the welding portions of the first and second conducting terminals can be positioned by the first and second fixing blocks. Therefore, it is not required to assemble a positioning socket to the first and second conducting terminals, and the problem that welding pins of the terminals may be deflected when the positioning socket is assembled does not occur, thereby reducing the product reject ratio, reducing the manufacturing cost, and also improving the production efficiency.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
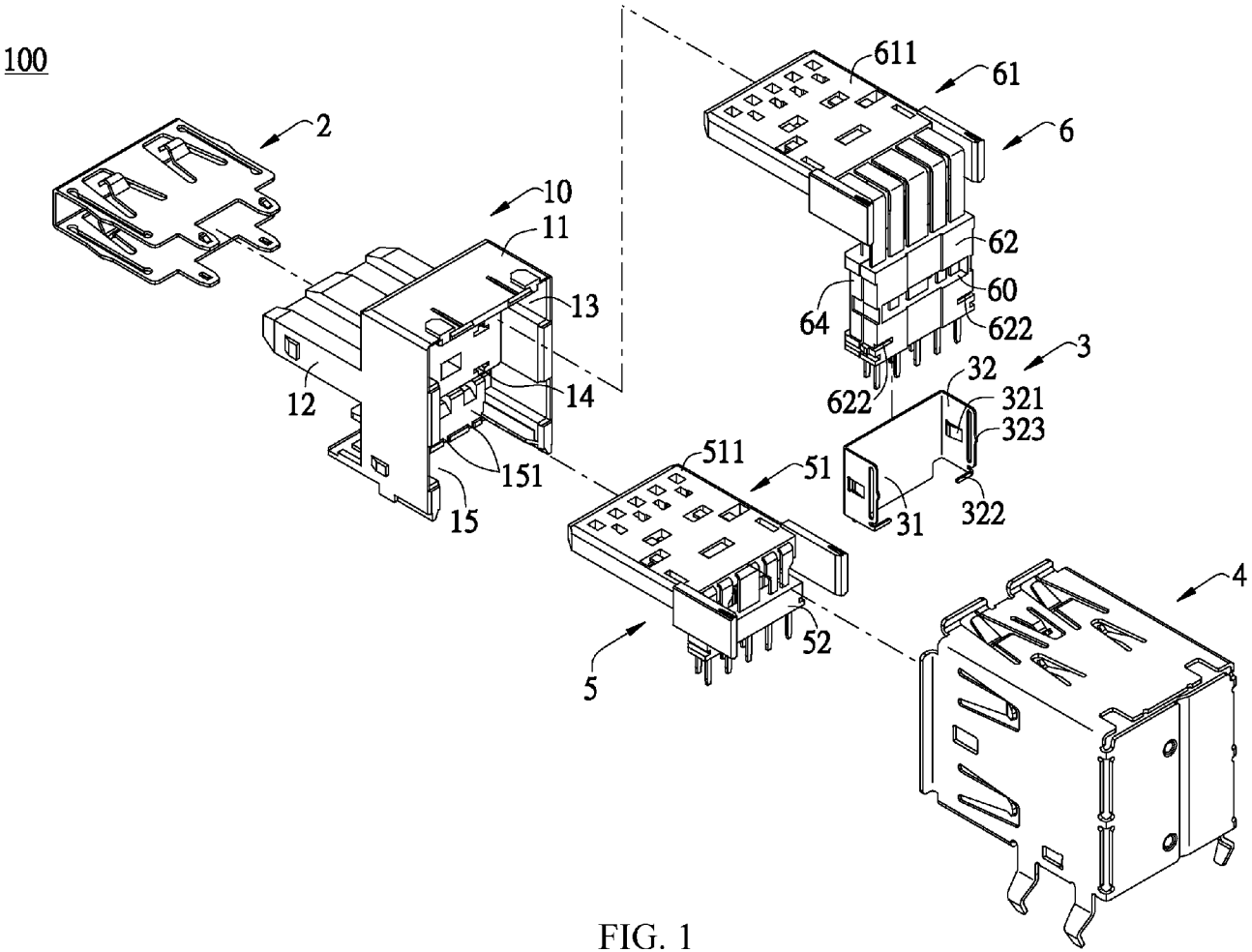
FIG. 1 is a schematic three-dimensional exploded view of a stacked electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

Figure 3:
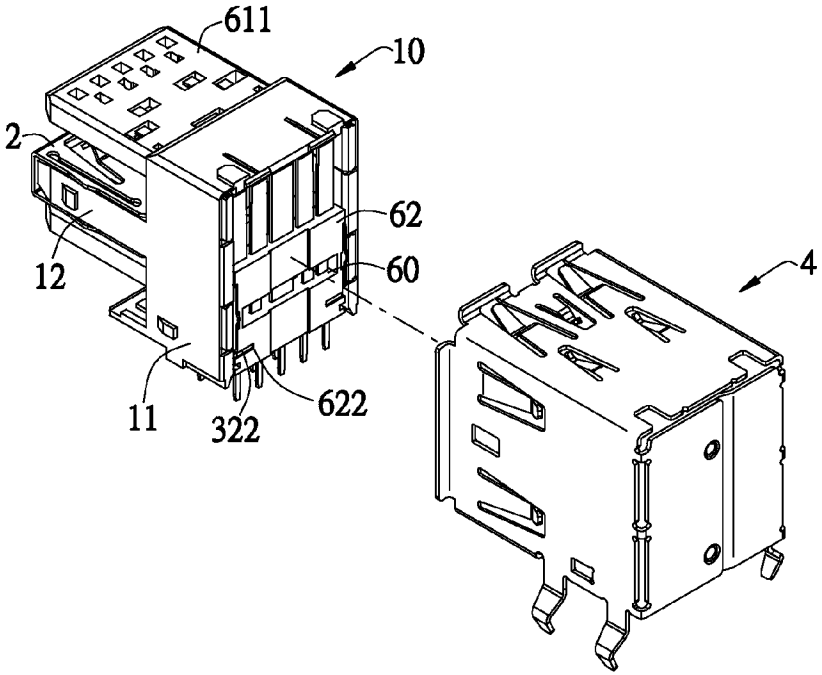
FIG. 3 is a schematic view of assembly of FIG. 1.
Figure 4:
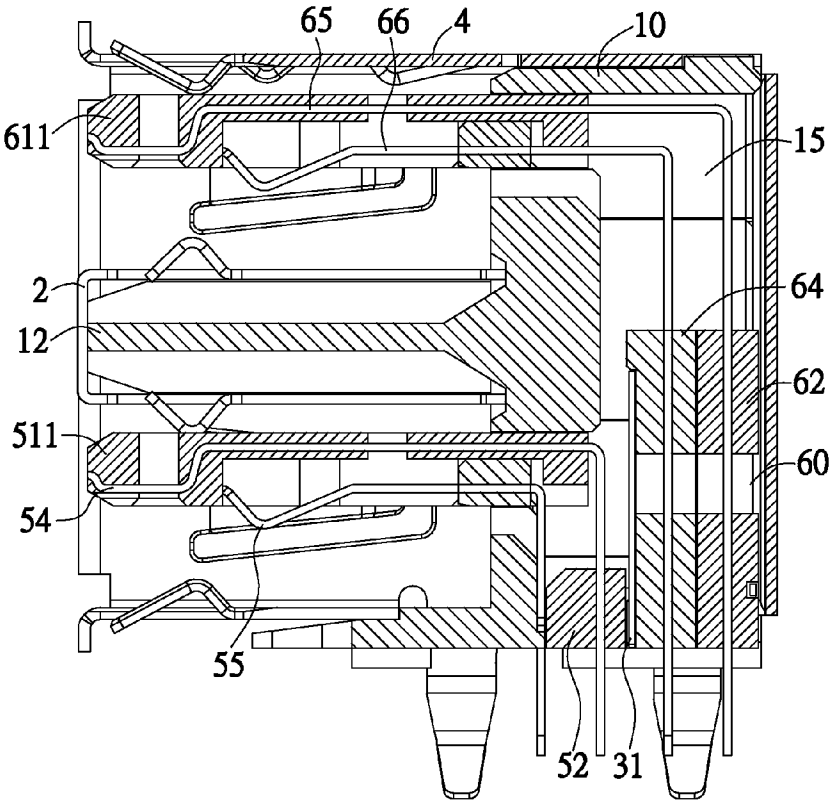
FIG. 4 is a schematic sectional view of the stacked electrical connector after assembly according to one embodiment of the present invention.

Referring to FIGS. 1, 3 and 4, a stacked electrical connector 100 according to one embodiment of the present invention includes a main body 10, a first electrical connector 5 and a second electrical connector 6 disposed on the main body 10, an inner shell 2, a shielding sheet 3 disposed between the first electrical connector 5 and the second electrical connector 6, and a shielding shell 4 wraps the first electrical connector 5, the second electrical connector 6 and the periphery of the main body 10.

Figure 2:
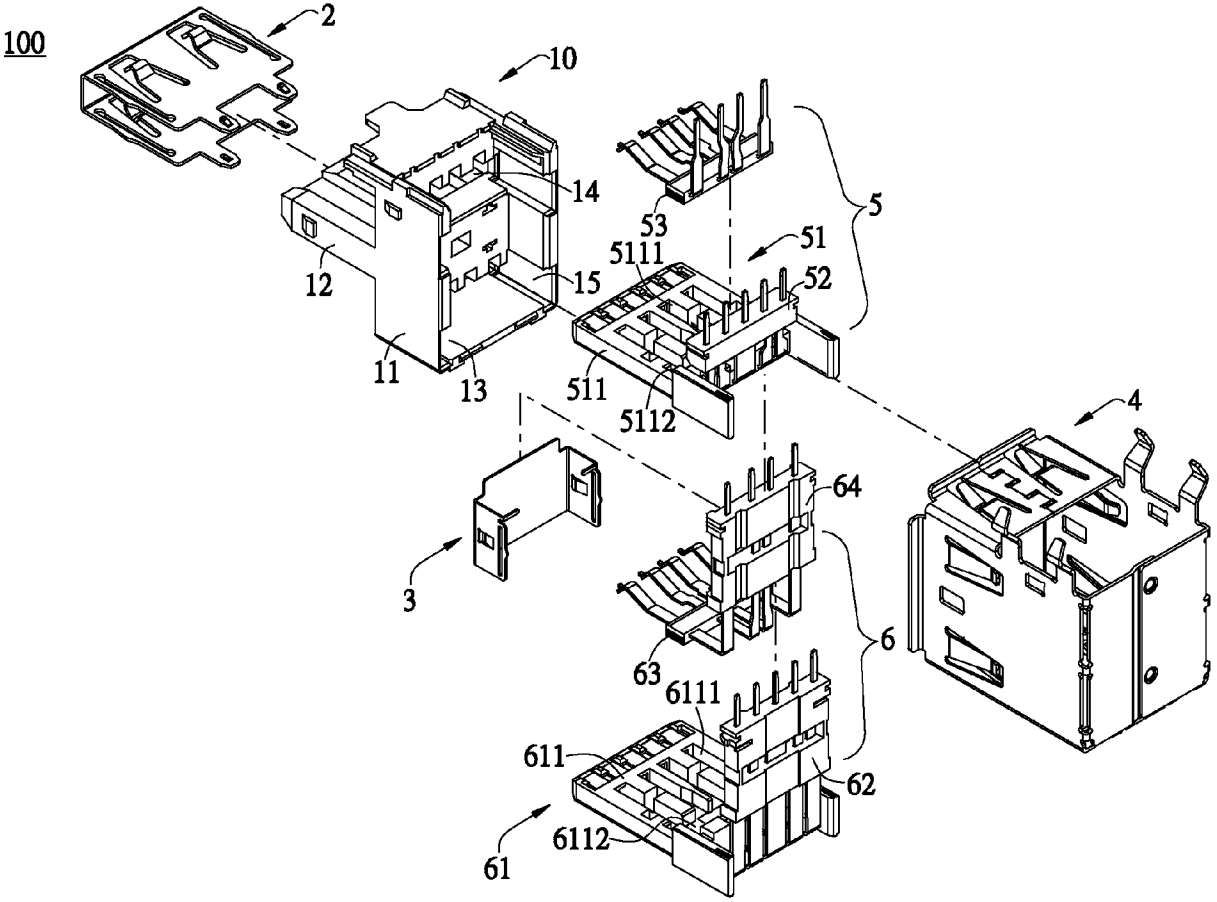
FIG. 2 is an exploded schematic view of FIG. 1 viewed from another angle.
Figure 7:
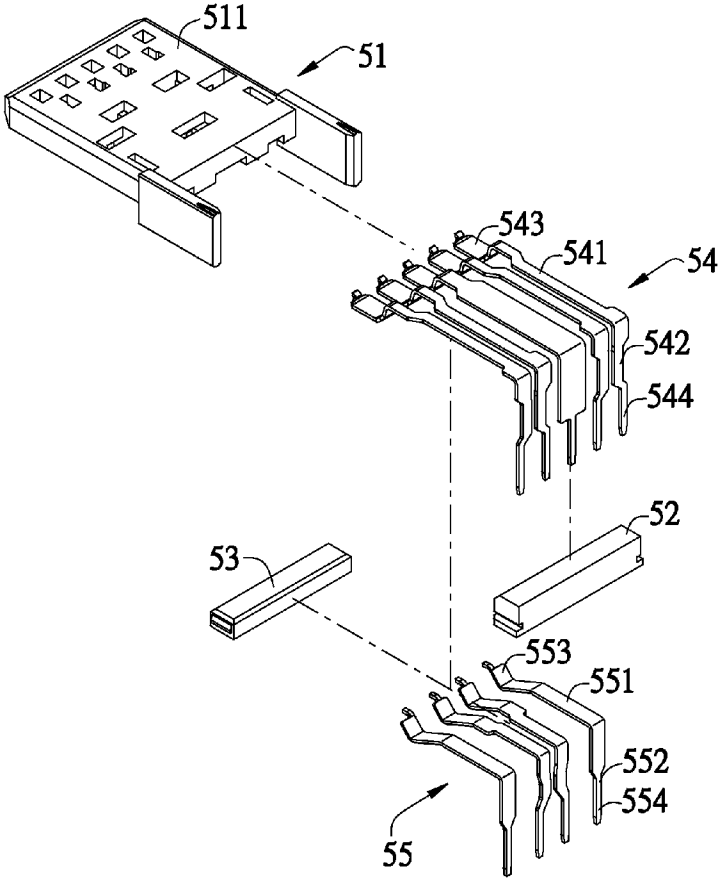
FIG. 7 is a schematic three-dimensional exploded view of a first electrical connector according to one embodiment of the present invention.

Referring to FIGS. 1, 2 and 7, the first electrical connector 5 is a USB 3.0 electrical connector. The first electrical connector 5 includes a third body 51, a third fixing block 52 disposed below the third body 51, and a fourth body 53 fixed onto the third body 51. Multiple third conducting terminals 54 are disposed in the third body 51 and the third fixing block 52, and multiple fourth conducting terminals 55 are disposed in the fourth body 53. The third body 51 includes a second tongue 511. The second tongue 511 has multiple second receiving slots 5111 and a second groove 5112. Each of the third conducting terminals 54 has a third retaining portion 541 insert injection molded in the second tongue 511, a third extending portion 542 bending downward and extending from a rear end of the third retaining portion 541, and insert injection molded in the third fixing block 52, a third contact portion 543 extending forward from the third retaining portion 541 and exposed from a front end of the second tongue 511, and a third welding portion 544 extending downward from the third extending portion 542 and exposed from the third fixing block 52. Each of the fourth conducting terminals 55 has a fourth retaining portion 551 insert injection molded in the fourth body 53, a fourth extending portion 552 bending downward and extending from a rear end of the fourth retaining portion 551, a fourth contact portion 553 extending forward from the fourth retaining portion 551 and beyond the fourth body 53, and a fourth welding portion 554 extending downward from the fourth extending portion 552. The fourth body 53 is assembled in the second groove 5112 of the second tongue 511 along the vertical direction, and the fourth contact portions 553 are correspondingly received in the second receiving slots 5111.

Figure 6:
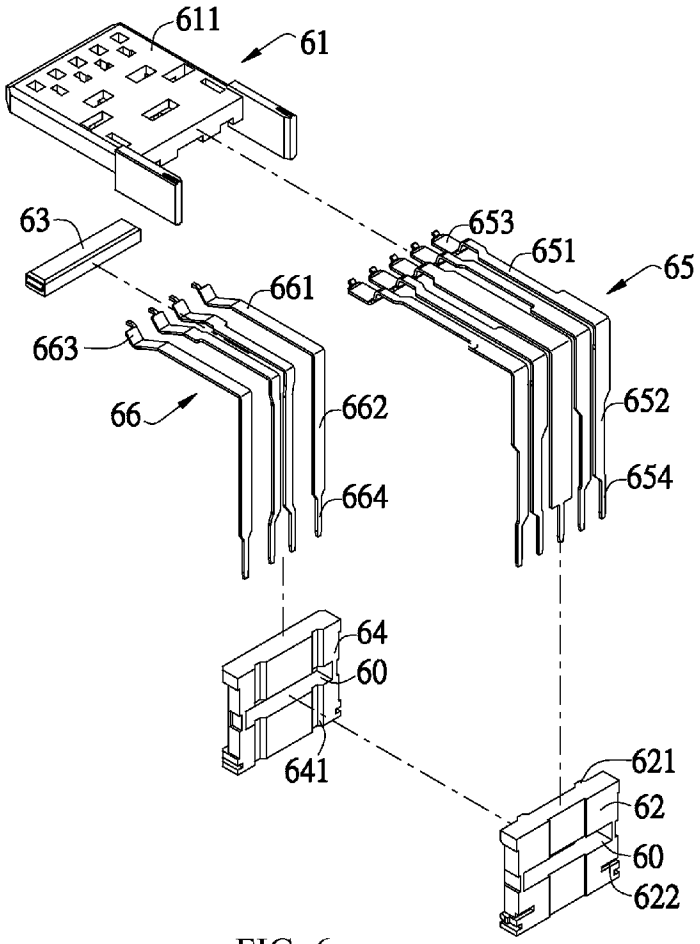
FIG. 6 is a schematic three-dimensional exploded view of a second electrical connector according to one embodiment of the present invention.

Referring to FIGS. 1, 2 and 6, the second electrical connector 6 likewise is a USB 3.0 electrical connector. The second electrical connector 6 includes a first body 61, a first fixing block 62 disposed below the first body 61, a second body 63 fixed on the first body 61, and a second fixing block 64 located below the second body 63. Multiple first conducting terminals 65 are disposed in the first body 61 and the first fixing block 62, and multiple second conducting terminals 66 are disposed in the second body 63 and the second fixing block 64. The first body 61 includes a first tongue 611. The first tongue 611 has multiple first receiving slots 6111 and a first groove 6112. Each of the first conducting terminals 65 has a first retaining portion 651 insert injection molded in the first tongue 611, a first extending portion 652 bending downward and extending from a rear end of the first retaining portion 651 and insert injection molded in the first fixing block 62, a first contact portion 653 extending forward from the first retaining portion 651 and exposed from a front end of the first tongue 611, and a first welding portion 654 extending downward from the first extending portion 652 and exposed from the first fixing block 62. Each of the second conducting terminals 66 has a second retaining portion 661 insert injection molded in the second body 63, a second extending portion 662 bending downward and extending from a rear end of the second retaining portion 661 and insert injection molded in the second fixing block 64, a second contact portion 663 extending forward from the second retaining portion 661 and beyond the second body 63, and a second welding portion 664 extending downward from the second extending portion 662 and exposed from the second fixing block 64. The second body 63 is assembled in the first groove 6112 of the first tongue 611 along the vertical direction, and the second contact portions 663 are correspondingly received in the first receiving slots 6111, and located below the first contact portions 653. The second fixing block 64 is correspondingly located in front of the first fixing block 62. A rear surface of the second fixing block 64 has multiple concave portions 641, a front surface of the first fixing block 62 has multiple convex portions 621 corresponding to the concave portions 641, and the concave portions 641 and the convex portions 621 cooperatively fix the first fixing block 62 and the second fixing block 64. The first fixing block 62 and the second fixing block 64 are further each provided with an opening 60, and the opening 60 runs through each of the first fixing block 62 and the second fixing block 64 from front to back, so that when the extending portions 652 of the first conducting terminals and the extending portions 662 of the second conducting terminals are insert injection molded in the first fixing block 62 and the second fixing block 64 respectively, a die core of a molding die (not shown) may clamp and position a terminal through the opening 60 to make the terminal locate at a precise location in the die (not shown). Two sides of the rear surface of the first fixing block 62 are further each provided with a notch 622.

Referring to FIG. 6 and FIG. 7, the first conducting terminals 65 and the third conducting terminals 54 are the same in specification, and both are terminals conforming to the USB 3.0 specification, which include a grounding terminal and two differential signal terminal pairs located at two sides of the grounding terminal. The second conducting terminals 66 and the fourth conducting terminals 55 are the same in specification, and both are terminals conforming to the USB 2.0 specification, which include a differential signal terminal pair, and a grounding terminal and a power supply terminal located at two sides of the differential signal terminal pair. Welding portions of two terminals of each of the differential signal terminal pairs are deviated from each other, so crosstalk interference between the terminals can be reduced.

Referring to FIG. 1, the shielding sheet 3 includes a shielding portion 31, two sides of the shielding portion 31 are each provided with a wall portion 32, a buckling portion 321 is disposed on each of the two wall portions 32, elastic arms 322 extending in opposite directions are further disposed below rear ends of the two wall portions 32, and ends of the two wall portions 32 are further each convexly provided with a contact portion 323.

Referring to FIG. 1 and FIG. 2, the main body 10 includes a base portion 11 and a partition board 12 extending forward from the base portion 11. The base portion 11 is provided with a first retaining slot 13 longitudinally running through the base portion 11 above the partition board 12, and provided with a second retaining slot 14 longitudinally running through the base portion 11 below the partition board 12. The rear end of the base portion 11 is provided with an accommodating space 15, and multiple positioning slots 151 are disposed below the rear end.

Referring to FIGS. 1, 3 and 4, during assembly, the inner shell 2 is inserted onto the partition board 12 from the front end of the main body 10. The third body 51 of the first electrical connector 5 is inserted forward into the second retaining slot 14 from the rear end of the base portion 11, the fourth extending portions 552 of the fourth conducting terminals 55 are respectively located in the positioning slots 151 (alternatively, in another embodiment, a fourth fixing block (not shown) may also be insert injection molded on the fourth extending portions 552 of the fourth conducting terminals 55, so that the welding portions 554 of the fourth conducting terminals 55 can be positioned by using the fourth fixing block, and the positioning slot 151 does not need to be disposed below the rear end of the base portion 11 of the main body 10), and the third fixing block 52 is located in the accommodating space 15. Then the shielding sheet 3 is assembled on the first fixing block 62 and the second fixing block 64. The shielding portion 31 is laminated to the front end of the second fixing block 64, the two wall portions 32 respectively wrap two sides of the first fixing block 62 and the second fixing block 64, and are buckled onto the second fixing block 64 by the buckling portion 321. The two elastic arms 322 are respectively received in the notches 622 at the two sides of the rear surface of the first fixing block 62. Then the first body 61 of the second electrical connector 6 is inserted forwardly into the first retaining slot 13 from the rear end of the base portion 11, so that the first fixing block 62 and the second fixing block 64 are located behind the third fixing block 52 and are likewise each accommodated in the accommodating space 15. The shielding sheet 3 is located between the first electrical connector 5 and the second electrical connector 6, and the second electrical connector 6 is located above the first electrical connector 5. Finally the shielding shell 4 is assembled onto the main body 10. The shielding shell 4 wraps the first electrical connector 5, the second electrical connector 6 and the main body 10, so as to together form the stacked electrical connector 100. The inner surface of the rear wall of the shielding shell 4 contacts the two contact portions 323 of the shielding sheet 3, so that the shielding sheet 3 is grounded by the shielding shell 4, so as to achieve the shielding efficacy.

Figure 5:
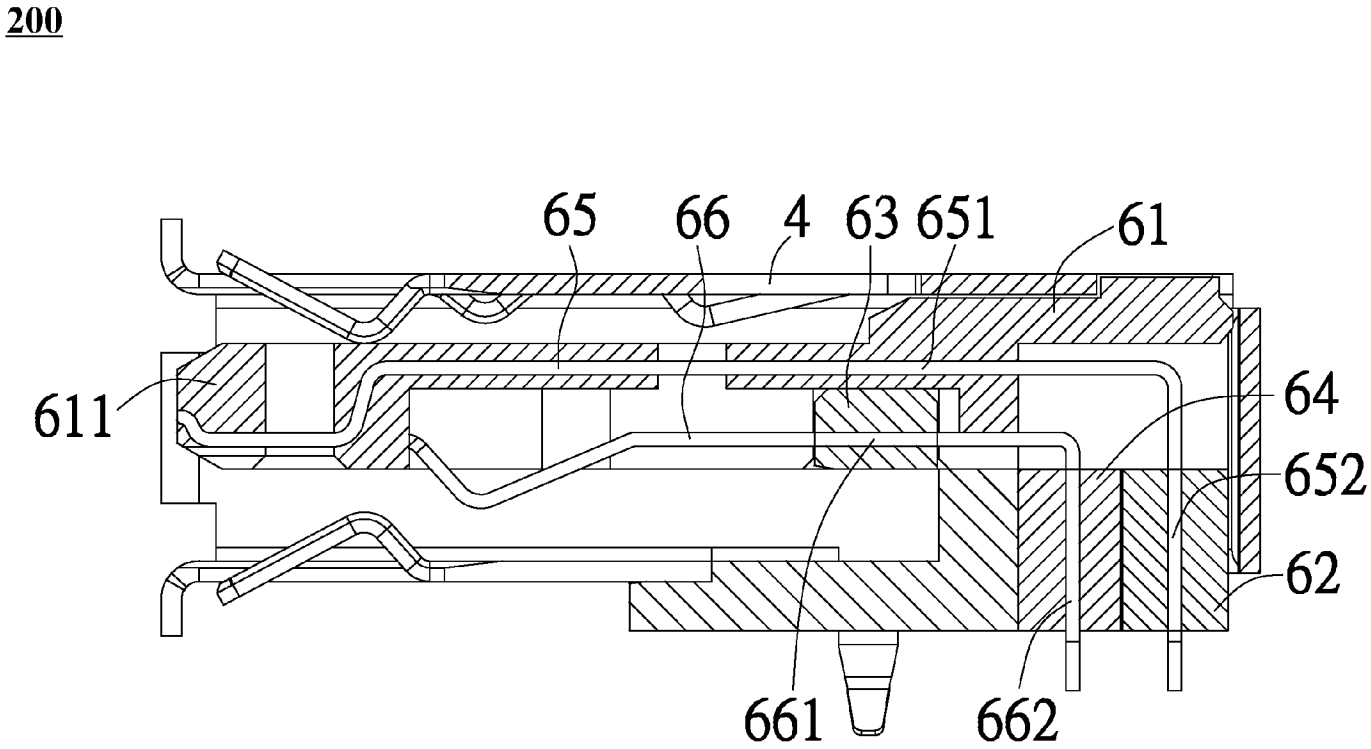
FIG. 5 is a schematic sectional view of an electrical connector according to one embodiment of the present invention.

Referring to FIG. 5, structural features of an electrical connector 200 according to one embodiment of the present invention are basically consistent with structural features of the second electrical connector 6. The electrical connector 200 includes a first body 61, a first fixing block 62 disposed below the first body 61, a second body 63 fixed onto the first body 61, and a second fixing block 64 located below the second body 63. Multiple first conducting terminals 65 are disposed in the first body 61 and the first fixing block 62, and multiple second conducting terminals 66 are disposed in the second body 63 and the second fixing block 64. Each of the first conducting terminals 65 has a first retaining portion 651 insert injection molded in the first tongue 611, and a first extending portion 652 insert injection molded in the first fixing block 62. Each of the second conducting terminals 66 has a second retaining portion 661 insert injection molded in the second body 63, and a second extending portion 662 insert injection molded in the second fixing block 64. The second body 63 is assembled in the first tongue 611 along the vertical direction, and the second fixing block 64 is correspondingly located in front of the first fixing block 62, which are together located below the rear end of the first body 61. A shielding shell 4 sleeves the periphery of the first body 61, and wraps the first body 61, the first fixing block 62 and the second fixing block 64.

In summary, the electrical connector and the stacked electrical connector formed by the same according to certain embodiment of the present invention, among other things, have the following beneficial advantages.

(1) Each of the first conducting terminals 65 has a first extending portion 652 insert injection molded in the first fixing block 62, and each of the second conducting terminals 66 has a second extending portion 662 insert injection molded in the second fixing block 64, so that the welding portions 654 of the first conducting terminals and the welding portions 664 of the second conducting terminals can be positioned using the first fixing block 62 and the second fixing block 64. A positioning socket is not required to be assembled to the first conducting terminals 65 and the second conducting terminals 66, and the problem that a welding pin of a terminal may be deflected when the positioning socket is assembled does not occur, thereby reducing the product reject ratio, reducing the manufacturing cost, and also improving the production efficiency.

(2) The shielding portion 31 of the shielding sheet 3 is located at the front end of the second fixing block 64, the wall portions 32 at the two sides of the shielding portion 31 are each provided with a buckling portion 321 buckled to a side of the second fixing block 64, elastic arms 322 extending in opposite directions are separately at two sides of the rear end of the wall portion 32, and the elastic arms 322 are respectively received in notches 622 at two sides of the rear surface of the first fixing block 62, so that the shielding sheet 3 is unlikely detaching away from the first fixing block 62 and the second fixing block 64, and the first fixing block 62 and the second fixing block 64 can be tightly fixed together.

(3) Welding portions of two terminals of each of the differential signal terminal pairs of the first conducting terminals 65, the second conducting terminals 66, the third conducting terminals 54 and the fourth conducting terminals 55 are deviated from each other, so that crosstalk interference between the terminals can be reduced.

(4) The first fixing block 62 and the second fixing block 64 are each provided with an opening 60, and the opening 60 longitudinally runs through each of the first fixing block 62 and the second fixing block 64, so that when the extending portions 652 of the first conducting terminals and the extending portions 662 of the second conducting terminals are insert injection molded into the first fixing block 62 and the second fixing block 64 respectively, the die core (not shown) of the molding die may clamp and position the first conducting terminal 65 and the second conducting terminal 66 using the opening 60 to make the first conducting terminals 65 and the second conducting terminal 66*s* locate at a precise location in the die (not shown).

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a first body;

a plurality of first conducting terminals received in the first body, wherein each of the first conducting terminals has a first extending portion, a first welding portion extending downward from the first extending portion, and a first retaining portion insert injection molded in the first body;

a second body;

a plurality of second conducting terminals received in the first body, wherein each of the second conducting terminals has a second extending portion, a second welding portion extending downward from the second extending portion, and a second retaining portion insert injection molded in the second body, and wherein the first extending portion and the second extending portion are disposed in a front and back manner;

a first fixing block, wherein the first extending portions are insert injection molded at the first fixing block; and a second fixing block, wherein the second extending portions are insert injection molded at the second fixing block, and the first fixing block and the second fixing block cooperatively position the first welding portions and the second welding portions, wherein the first body comprises a tongue, the tongue has a plurality of receiving slots and a groove, the second conducting terminals are correspondingly received in the receiving slots, and the second body is accommodated in the groove.

2. The electrical connector according to claim 1, wherein the first fixing block and the second fixing block have a concave portion and a convex portion in cooperation with each other.

3. The electrical connector according to claim 1, wherein the first conducting terminals comprise two first differential signal terminal pairs, and a first grounding terminal located between the two first differential signal terminal pairs, and wherein the two first welding portions of each of the first differential signal terminal pairs are deviated from each other.

4. The electrical connector according to claim 3, wherein the second conducting terminals comprise a power supply terminal, a second grounding terminal, and a second differential signal terminal pair located between the power supply terminal and the second grounding terminal, and wherein the two second welding portions of the second differential signal terminal pair are deviated from each other.

5. An electrical connector, comprising:

a first body having a plurality of receiving slots;

a first fixing block disposed below the first body;

a plurality of first conducting terminals, each comprising:

a first retaining portion insert injection molded in the first body;

a first extending portion bending downward and extending from a rear end of the first retaining portion, and insert injection molded in the first fixing block;

a first contact portion extending forward from the first retaining portion and exposed from the first body; and a first welding portion extending downward from the first extending portion and exposed from the first fixing block;

a second body;

a second fixing block disposed below the second body; and a plurality of second conducting terminals, each comprising:

a second retaining portion insert injection molded in the second body;

a second extending portion bending downward and extending from a rear end of the second retaining portion, and insert injection molded in the second fixing block;

a second contact portion extending forward from the second retaining portion and exposed from the second body; and a second welding portion extending downward from the second extending portion and exposed from the second fixing block, wherein the second body is assembled in the first body; and wherein the second contact portions are received in the receiving slots, located below the first contact portions, and exposed from the first body.

6. The electrical connector according to claim 5, wherein the first fixing block and the second fixing block are disposed in a front and back manner, and the first fixing block and the second fixing block cooperatively position the first welding portions and the second welding portions.

7. The electrical connector according to claim 6, wherein the first fixing block and the second fixing block are each provided with an opening, and the opening longitudinally runs through each of the first fixing block and the second fixing block.

8. The electrical connector according to claim 5, wherein the first conducting terminals comprise two first differential signal terminal pairs, and a first grounding terminal located between the two first differential signal terminal pairs, and wherein the two first welding portions of each of the first differential signal terminal pairs are deviated from each other.

9. The electrical connector according to claim 8, wherein the second conducting terminals comprise a power supply terminal, a second grounding terminal, and a second differential signal terminal pair located between the power supply terminal and the second grounding terminal, and wherein the two second welding portions of the second differential signal terminal pair are deviated from each other.

10. A stacked electrical connector, comprising:

a first electrical connector;

at least one second electrical connector stacked above the first electrical connector, wherein the second electrical connector has a first body, a second body, and at least two rows of conducting terminals, wherein each of the conducting terminals has an extending portion, and a welding portion extending downward from the extending portion, and wherein the extending portions of the two rows of conducting terminals are disposed in two rows in a front and back manner; and a first fixing block and a second fixing block, wherein the two rows of extending portions are respectively insert injection molded in the first fixing block and the second fixing block, and the first fixing block and the second fixing block cooperatively position the welding portions of the two rows of conducting terminals;

wherein the two rows of conducting terminals comprise a plurality of first conducting terminals and a plurality of second conducting terminals, each of the first conducting terminals has a first retaining portion insert injection molded in the first body and a first extending portion insert injection molded in the first fixing block, and each of the second conducting terminals has a second retaining portion insert injection molded in the second body and a second extending portion insert injection molded in the second fixing block; and wherein the first body comprises a first tongue, and the second conducting terminals and the second body are assembled in the first tongue.

11. The stacked electrical connector according to claim 10, wherein the first electrical connector comprises a third body, a fourth body, a plurality of third conducting terminals, and a plurality of fourth conducting terminals, each of the third conducting terminals has a third retaining portion insert injection molded in the third body, and each of the fourth conducting terminals has a fourth retaining portion insert injection molded in the fourth body.

12. The stacked electrical connector according to claim 11, wherein the first electrical connector further comprises a third fixing block, and each of the third conducting terminals has a third extending portion insert injection molded in the third fixing block.

13. The stacked electrical connector according to claim 12, wherein the third body comprises a second tongue, and the fourth conducting terminals and the fourth body are assembled in the second tongue.

14. The stacked electrical connector according to claim 13, further comprising a main body, wherein the main body has a base portion, the base portion is provided with a first retaining slot and a second retaining slot which longitudinally run through the base portion, and the first tongue and the second tongue are retained in the first retaining slot and the second retaining slot respectively.

15. The stacked electrical connector according to claim 14, wherein a rear end of the base portion is provided with an accommodating space, and the first fixing block, the second fixing block, and the third fixing block are respectively accommodated in the accommodating space.

16. The stacked electrical connector according to claim 15, wherein a plurality of positioning slots are disposed below the rear end of the base portion, and each of the fourth conducting terminals has a fourth extending portion located in a corresponding positioning slot.

17. The stacked electrical connector according to claim 15, wherein a shielding sheet is disposed between the third fixing block and the second fixing block, and wherein the shielding sheet has a shielding portion, and wall portions located at two sides of the shielding portion.

18. The stacked electrical connector according to claim 17, wherein the two wall portions respectively wrap two sides of the first fixing block and the second fixing block, and the two wall portions are each provided with a buckling portion buckled on the second fixing block.

19. The stacked electrical connector according to claim 18, wherein rear ends of the two wall portions respectively extend in opposite directions and are each provided with an elastic arm, the first fixing block has notches corresponding to the elastic arms, and the elastic arms are received respectively in the notches.

* * * * *